US009840763B2

(12) United States Patent
Deal et al.

(10) Patent No.: US 9,840,763 B2
(45) Date of Patent: Dec. 12, 2017

(54) METHOD FOR ALTERING METAL SURFACES

(71) Applicant: GENERAL ELECTRIC COMPANY, Schenectady, NY (US)

(72) Inventors: Andrew David Deal, Niskayuna, NY (US); Laura Cerully Dial, Clifton Park, NY (US); Christopher Jay Klapper, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 14/735,617

(22) Filed: Jun. 10, 2015

(65) Prior Publication Data

US 2016/0362773 A1 Dec. 15, 2016

(51) Int. Cl.

| | |
|---|---|
| ***C23C 2/12*** | (2006.01) |
| ***C23C 2/14*** | (2006.01) |
| ***C23C 2/26*** | (2006.01) |
| ***B05D 7/22*** | (2006.01) |
| ***C22C 21/02*** | (2006.01) |
| ***C22C 27/06*** | (2006.01) |
| ***C22C 27/04*** | (2006.01) |
| ***C23C 2/34*** | (2006.01) |

(52) U.S. Cl.

CPC ..... *C23C 2/26* (2013.01); *B05D 7/22* (2013.01); *C22C 21/02* (2013.01); *C22C 27/04* (2013.01); *C22C 27/06* (2013.01); *C23C 2/12* (2013.01); *C23C 2/14* (2013.01); *C23C 2/34* (2013.01)

(58) Field of Classification Search

CPC .... C23C 2/12; C23C 2/14; C23C 2/16; C22C 21/02; C22C 27/06; B05D 7/22

USPC ..... 148/242, 276, 281, 512, 320, 421, 423, 148/425, 426, 428, 437; 427/230, 430.1

See application file for complete search history.

(56) References Cited

U.S. PATENT DOCUMENTS

| | | | | |
|---|---|---|---|---|
| 3,220,876 | A * | 11/1965 | Moeller | C23C 10/22 427/432 |
| 5,234,636 | A | 8/1993 | Hull et al. | |
| 5,496,449 | A | 3/1996 | Ishibashi et al. | |
| 6,007,318 | A | 12/1999 | Russell et al. | |
| 8,506,836 | B2 * | 8/2013 | Szuromi | B22F 3/1055 216/102 |
| 8,506,862 | B2 | 8/2013 | Giller et al. | |
| 8,765,045 | B2 | 7/2014 | Zinniel | |
| 2015/0044084 | A1 | 2/2015 | Hofmann et al. | |

OTHER PUBLICATIONS

Choi et al., "Wetting of Solid Al2O3 with Molten CaO—Al2O3—SiO2," ISIJ International, vol. 43 (2003), No. 9, pp. 1348-1355.*

L.M. Galantucci et al.,"Quantitative analysis of a chemical treatment to reduce roughness of parts fabricated using fused deposition modeling", CIRP Annals—Manufacturing Technology, vol. 59, pp. 247-250, 2010.

Y. Pan et al.,"Smooth surface fabrication in mask projection based stereolithography", Journal of Manufacturing Processes, vol. 14, Issue 4, pp. 460-470, Oct. 2012.

N.A. El-Mahallawy et al.,"Analysis of coating layer formed on steel strips during aluminising by hot dipping in Al—Si baths", Materials Science and Technology, vol. 13, Issue 10, pp. 832-840, Oct. 1997.

* cited by examiner

*Primary Examiner* — William Phillip Fletcher, III

(74) *Attorney, Agent, or Firm* — John P. Darling

(57) ABSTRACT

A method for reducing surface roughness of an article includes contacting a surface of an article with a molten metal agent, the surface having an initial roughness; altering at least a portion of the surface in the molten metal agent; and removing the surface from contact with the agent; wherein, after the removing step, the surface has a processed roughness that is less than the initial roughness.

27 Claims, 1 Drawing Sheet

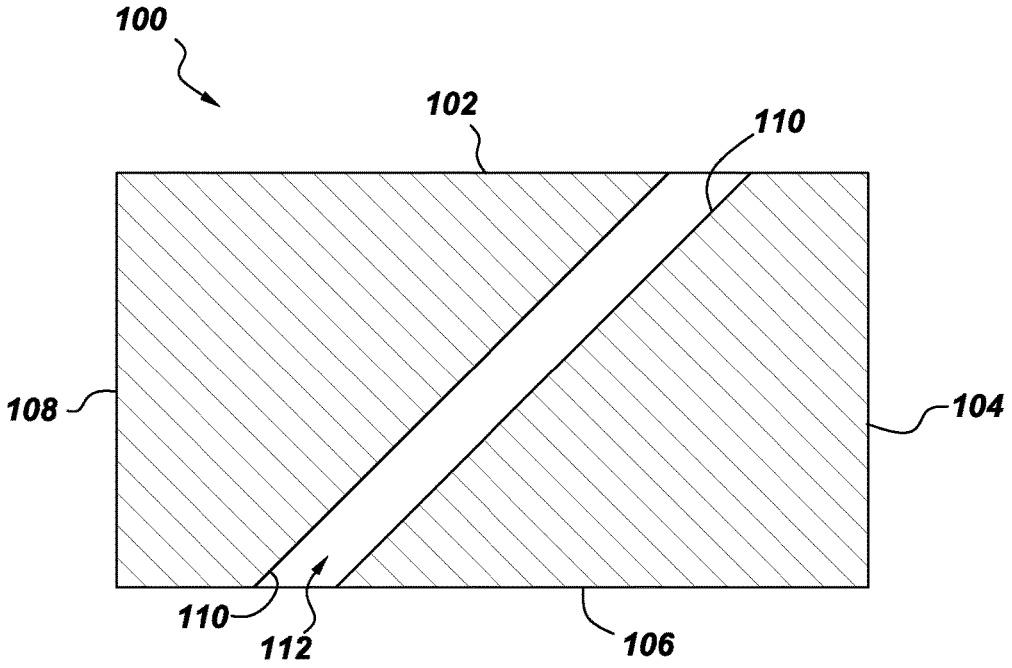
100
102
110
108
104
110
112
106

METHOD FOR ALTERING METAL SURFACES

BACKGROUND

This disclosure generally relates to methods for fabricating articles; more particularly, this disclosure relates to methods for reducing surface roughness of articles, such as, but not limited to, metal articles formed by additive manufacturing processes.

Manufacturing methods that rely on the addition of material to "build" components portion by portion, such as layer by layer, often suffer from unduly high levels of surface roughness, attributable in part to incomplete leveling of surfaces formed, for example, by melted (or partially melted) and solidified powder feed-stocks. Spray-forming and thermal spraying are two such processes used to form coatings or freestanding articles. The so-called "additive manufacturing" methods are further examples, and these methods are of particular interest to industry for their potential to fabricate complex three-dimensional parts with reduced cost and increased throughput relative to conventional metalworking processes such as casting and forging. The term "additive manufacturing" is defined by the American Society for Testing and Materials as the "process of joining materials to make objects from three-dimensional model data, usually layer upon layer, as opposed to subtractive manufacturing methodologies, such as traditional machining and casting." Such processes have demonstrated capability to manufacture components with complex features, including, for example, internal channels for facilitating fluid flow, such as for cooling or fluid delivery.

High surface roughness on external surfaces or internal channel walls may act to hinder component functionality where, for example, fluid flow plays a role in the working of the component. For example, turbine airfoil components such as blades and vanes typically specify upper limits for roughness of certain external surfaces to maintain aerodynamics of gas flow within design parameters. Moreover, components that facilitate flow of liquid are typically desired to have flow channels, such as internal flow channels, with channel wall surface roughness below specified limits to promote efficient flow and reduce fouling of channels by debris. Finally, unduly high surface roughness may also detract from mechanical properties of articles; for instance, high surface roughness may promote fatigue crack initiation in some applications, reducing the life of components relative to those having a smoother surface.

Given the potentially detrimental effects of high surface roughness, there is a need for methods to reduce surface roughness for components, such as components fabricated by additive manufacturing methods, where surface roughness issues are common.

BRIEF DESCRIPTION

Embodiments of the present invention are provided to meet this and other needs. One embodiment is a method. The method comprises contacting a surface of an article with a molten metal agent, the surface having an initial roughness; altering at least a portion of the surface in the molten metal agent; and removing the surface from contact with the agent; wherein, after the removing step, the surface has a processed roughness that is less than the initial roughness.

Another embodiment is a method, comprising: contacting a surface of a metal article with a molten metal agent, the surface having an initial roughness; altering at least a portion of the surface in the agent; and removing the article from contact with the agent; wherein the metal article comprises cobalt and chromium, and the agent comprises aluminum; and wherein, after the removing step, the surface has a processed roughness that is less than about 95% of the initial roughness.

DRAWINGS

These and other features, aspects, and advantages of the present invention will become better understood when the following detailed description is read with reference to the accompanying drawing in which like characters represent like parts, wherein:

The FIGURE illustrates a schematic cross section of an article in accordance with embodiments of the present invention.

DETAILED DESCRIPTION

Approximating language, as used herein throughout the specification and claims, may be applied to modify any quantitative representation that could permissibly vary without resulting in a change in the basic function to which it is related. Accordingly, a value modified by a term or terms, such as "about", and "substantially" is not to be limited to the precise value specified. In some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable.

The techniques described herein serve to reduce the surface roughness of articles, regardless of how those articles are fabricated. However, given the propensity of additive manufacturing methods to produce articles with unduly high surface roughness, emphasis will be given in the description below of the applicability of the described methods to improve additively manufactured articles. This emphasis should not be construed as limiting, however, and the more general applicability of the described methods will be apparent to practitioners in the manufacturing arts.

As it is used in this description, and indeed as it is typically used in the field of surface metrology, the term "surface roughness" (also, interchangeably herein, "roughness") generally refers to a statistical expression of high-frequency deviations of surface height from a nominal baseline value, often a local mean surface height. As is well-known in the art, many different parameters may be used to describe the roughness of a given surface, and each of these parameters has advantages and disadvantages. Profile roughness parameters such as the arithmetic average of absolute values ($R_a$) and the root mean squared roughness ($R_q$) are commonly used parameters because they are readily measured using standard profilometry equipment and are easily calculated, though such measurements may not always provide the most useful description of a surface's roughness characteristics. Standard B46.1 of the American Society of Mechanical Engineers (ASME) provides procedures for measuring and calculating several different profile roughness parameters, including those noted above. Other types of roughness measures include parameters calculated over an area, as described in ISO 25178 published by International Organization for Standardization. Still other parameters are known and described in the literature.

For the purposes of the present description, "surface roughness" (and its abbreviated equivalent, "roughness") will be understood to include any one or more of these parameters, wherein a surface of interest on an article to be processed in accordance with the description herein has an "initial roughness" prior to being exposed to the method, and a "processed roughness" after being exposed to the method. In one embodiment, the roughness parameter is a profile roughness parameter such as $R_a$. For example, in some embodiments, the surface of the article has an initial roughness of at least about 200 micro-inches (5 micrometers) $R_a$.

In accordance with an embodiment of the described method, a surface of an article is contacted with a molten metal agent, and at least a portion of the surface is altered in the agent through a reaction, dissolution, and/or other mechanism, thereby, upon removal of the agent and any associated reaction products at the surface of the article, reducing the roughness of the surface from a comparatively high initial roughness value to a comparatively low processed roughness value. In some embodiments, the processed roughness is less than about 95% of the initial roughness.

As used herein, a "surface" constitutes any portion of an article that is in contact with the article's ambient environment. Referring now to the FIGURE, a cross-sectional view of an illustrative article 100, the term "surface" with respect to article 100 encompasses not only external surfaces 102, 104, 106, 108, but also internal surfaces such as a wall 110 of an internal channel 112 disposed within article 100. Therefore, in one particular example, the contacting step includes introducing the agent into internal channel 112, where the surface being contacted includes the channel wall 110.

In some embodiments, at least a portion of the article—a portion of the article that includes the surface to be treated—includes additively manufactured material, that is, material disposed by an additive manufacturing technique. Typical additive manufacturing methods involve precise deposition of material (as by micro-pen deposition of a liquid followed by curing) or selective, localized densification of material (as by selective melting and solidification or sintering a powder, using a laser or other highly focused form of energy) to form a series of thin, cross-sectional slices, or layers, that in aggregate build a three-dimensional component. The layer formation generally is done in accordance with a computer-based model or other design model that describes the location and dimensions of internal and external surfaces of the article in three-dimensional space. One particular example is a process referred to in the art as direct metal laser melting (DMLM). The DMLM process includes the use of a laser to melt and solidify a powdered starting material, layer-by-layer, into a three dimensional object. Hence, an "additively manufactured material" may often be identified as material comprising a series of layers of former powder particles that have been joined together by a sintering operation or, in most cases involving metal materials, a melt-and-solidification operation, associated with the additive manufacturing process.

In some embodiments, the method described herein includes forming at least a portion of the article by a process that includes an additive manufacturing step; typically that portion includes the surface that is ultimately treated through contact with the molten metal agent. Article 100, when formed using one or more additive manufacturing processes, may have significant surface roughness caused, for example, by inclusion of incompletely melted metallic powder, and by contamination, debris, oxidation, melt pool instability, and other undesirable mechanisms that may occur as by-products of any of these various processes.

In some embodiments, the article is a component of a turbine assembly. Examples of such components include components that include airfoil portions, such as rotor blades and stator vanes. Other examples include shafts, shrouds, fan components, compressor components, and combustion components. Various turbine assembly components often include internal channels 112 to facilitate flow of a fluid, including, for example, cooling air or, as another example, liquids such as coolants or fuel. Accordingly, the techniques described herein may be applied to external surfaces, internal surfaces, or both of these, occurring on or within such components.

Prior to contacting the surface of the article with the molten metal agent, the article, in some embodiments, is pretreated with one or more materials that act to enhance the interaction between the molten metal agent and the surface to be treated, thereby promoting the ultimate reduction in surface roughness. Such materials are referred to herein collectively as "surface enhancement aids." Typically, a surface enhancement aid promotes one or more of the following functions: wetting between the surface and the molten metal agent; fluxing, such as preventing oxides from forming on the surface (and/or removing oxides that previously formed on the surface) to provide direct contact between the metal surface and the molten metal agent; promoting reaction between the surface and the molten metal agent (such as to form more readily removable reaction products); and increasing the solubility of the surface material in the molten metal agent.

In some embodiments, the surface of the article that is contacted with the molten metal agent comprises a metal, such as, but not limited to, cobalt, iron, nickel aluminum, titanium, or any combination that includes one or more of these. In one particular embodiment, the surface comprises an alloy comprising cobalt and chromium. An example of such an alloy includes an alloy that comprises from about 26 weight percent to about 30 weight percent chromium and from about 4 weight percent to about 7 weight percent molybdenum, with the balance comprising cobalt. Other alloying elements may be present as well. This illustrative alloy has been used with some success in additive manufacturing of some metal components.

Contacting the surface of an article with the agent, whether that surface is an external surface (such as external surface 102) or an internal surface (such as channel wall 110), may be accomplished in a number of different ways. For example, in one embodiment, contacting includes flowing the agent over the surface, as by pumping the agent over the surface or allowing the agent to flow over the surface by action of gravity, capillary forces, centrifugal force (as by spinning the article, for example), or any other means of applying force to the system to cause flow. Additionally or alternatively, the article may be immersed in the agent, as by dipping the article into a quantity of the agent, with or without accompanying agitation of the agent or some other technique to maintain relative motion between the agent and the surface. Maintaining relative motion is advantageous in instances where, for example, reaction products are generated by a chemical reaction between the surface and the agent; an accumulation of such products could, over time, come to occlude the surface from unreacted agent, slowing the process of removing material from the surface of the article into the agent.

The molten metal agent acts as a solvent for the material of the solid surface, and/or, in some cases, is a source for reactants that combine with the solid surface to form products that are then removed from the surface by action of the molten metal agent or by a subsequent cleaning operation (including, for example, the step of removing the surface from contact with the agent). Thus, in some embodiments, the altering step includes a dissolution of material from the surface (such as surface material and/or reaction products formed at the surface), a reaction between the agent and the surface material, or combinations of these. The molten metal agent is desirably not prone to diffuse rapidly into the material of the surface, reducing the risk of contaminating, and altering the properties of, the surface material. Thus, the composition of the molten metal agent is selected based in part on the composition of the surface to be processed. The agent may be a substantially pure elemental metal, where "substantially pure" in this context means the agent includes only the elemental metal, free of intentional alloying additions, but possibly including incidental impurities. In other embodiments, the molten metal agent may include a primary metal element and one or more alloying elements. Here, the use of the term "primary" is not intended to imply anything about the relative amount of the element present in the agent; this term is used as a differentiating term only.

An alloying element may be selected because of one or more advantageous properties it provides to the molten metal agent. For example, certain elements, such as boron, silicon, and lithium, added in the correct proportion to certain primary metal elements, may lower the melting point of the agent relative to the nominal melting point of the primary element; such alloying elements are referred to herein as "melting point depressants," though it will be appreciated that use of this term does not imply that these elements cannot perform additional functions in the agent beyond lowering melting point. Use of a lower melting point agent may be advantageous in some instances where the article is made of heat-sensitive material, in addition to inherently lower power requirements for operating the process. In certain embodiments, the composition of the agent is selected to have a melting point below about 1000 degrees Celsius, and in particular embodiments, the molten metal agent is at a temperature in a range from about 500 degrees Celsius to about 1000 degrees Celsius. Some elements may lower the melting point of materials in the surface to be processed, making the material more readily removable from the surface by the agent. For example, bismuth in the molten agent may interact with cobalt from the surface, lowering the melting point of the cobalt. Moreover, some elements may serve to promote alteration of the surface by increasing the reactivity and/or solubility of the surface material in the agent, by enhancing wetting of the surface by the agent, and/or by providing a fluxing function at the surface. The actual effects manifested by specific elements will depend in part on the composition of the melt, the composition of the surface, and the conditions (such as temperature and atmosphere) under which contacting the agent with the surface is performed.

In some embodiments, the molten metal agent comprises aluminum, bismuth, tin, or alloys that include one or more of these elements, such as alloys comprising aluminum and silicon, for example. These elements, and/or some of their alloys, have relatively low melting points and suitable solubility for (and/or reactivity with) one or more materials from which useful articles may be formed. In one illustrative embodiment, the molten metal agent comprises aluminum and up to about 14 weight percent silicon. Aluminum has a nominal melting point of about 660 degrees Celsius, and additions of silicon of up to about 14 weight percent in aluminum may lower the melting point by over 80 degrees Celsius due to the presence of a eutectic point at about 13 weight percent silicon. Moreover, silicon may enhance the surface alteration of certain alloys that include chromium, such as by reacting with the chromium to form products that are more readily removable by the molten metal agent or subsequent cleaning step (such as the removing step described herein) than is the original, unreacted surface material.

The composition of the molten metal agent, in some embodiments, is maintained during the contacting step by discrete or continuous additions of materials to the molten metal agent to compensate for changes in chemistry at the surface of the article due to reaction with the molten metal agent. Whether or not to apply compositional maintenance techniques will depend in part on a number of factors, including but not limited to the relative quantity of molten metal agent reacting with the surface, and the degree to which the reaction rate at the surface is sensitive to changes in chemistry.

The degree to which the molten metal agent wets the surface of the article during the contacting step may be a significant factor in achieving adequate smoothing of the surface. As noted above, various pretreatments of the surface, and additives in the molten metal agent, may be applied in part to enhance wetting. Additionally, the atmosphere in which the contact takes place may significantly affect the degree of wetting, because the degree of wetting is a function of the interactions among all three phases present in the system: the solid article, the liquid metal agent, and the gaseous atmosphere. In some embodiments, the atmosphere is air, which of course is attractive in that no special atmospheric control is required. However, as illustrated below in the provided examples, wetting under certain circumstances may be enhanced by contacting under a different atmosphere, such as an inert atmosphere. As used herein, the term "inert atmosphere" means a quantity of gas present over the article where the gas has substantially no chemical reactivity with the article and molten metal agent during the contacting step. Non-limiting examples of suitable gas include helium and argon. In one embodiment, the atmosphere consists essentially of argon. In some embodiments, the inert atmosphere is a vacuum, that is, an environment surrounding the article that is maintained at a pressure below nominal atmospheric pressure that is, less than about 100 kilopascals (1 atmosphere). Typically, the vacuum is not perfect, that is, there is some finite quantity of gas present in the environment, albeit at a low pressure. For this reason, the term "vacuum" as used herein is intended to cover any condition in which pressure is maintained below nominal atmospheric pressure, including a so-called "partial vacuum." The vacuum is maintained such that the gaseous constituents present in the environment do not substantially react with the melt and/or the molten metal agent.

After contact between the surface of the article and the molten metal agent has been maintained for an amount of time sufficient to achieve the desired reduction of surface roughness for the surface being treated, the article is removed from contact with the agent. The amount of time contact is maintained will depend on the materials used, the temperature, and the levels of roughness observed in the article prior to treatment and desired for the article post-treatment. In some embodiments, removal is achieved by mechanically removing the article from contact with the agent. For example, where the agent remains in liquid form, the contact may be broken by applying a force to the liquid or to the article that separates the agent from the surface. Blowing gas through an internal channel, for example, may be used to force agent out away from the article. Other examples include spinning or shaking the article; any one or a combination of techniques appropriate to the applicable materials and geometry of the article may be applied. Alternatively, all or a portion of the agent may cool and solidify while in contact with the article, such as where the article is removed from a pool of the agent with some agent allowed to remain clinging to the surface of the article. The solidified agent, and in some cases, any reaction products formed at the article surface during the contacting step, may then be removed by mechanical means, such as by chipping or grinding it away, or it may be removed chemically, as by dissolving or washing away in a solution of appropriate chemical activity, such as an acid or base.

In one illustrative embodiment, a method in accordance with the techniques described above includes the steps of contacting a surface of a metal article with a molten metal agent, the surface having an initial roughness; altering at least a portion of the surface in the agent; and removing the article from contact with the agent; wherein the metal article comprises cobalt and chromium, and the agent comprises aluminum; and wherein, after the removing step, the surface has a processed roughness that is less than about 95% of the initial roughness.

As noted above, upon removal of the agent from the surface, the surface may exhibit a processed surface roughness that is lower than the initial roughness. With a smoother surface, the article may perform more efficiently or otherwise more acceptably for its intended purpose. For instance, a turbine airfoil may benefit from having a smoother external surface with respect to its aerodynamic performance, and smoother shafts may benefit through reduced friction and wear.

EXAMPLES

The following examples are presented to further illustrate non-limiting embodiments of the present invention.

Example 1

A magnesium oxide crucible containing an alloy of aluminum with 12 weight percent silicon was brought to a set point temperature of 750 degrees Celsius in a vertical tubular furnace. The top cover of the furnace was removable, enabling exposure of the molten metal. Slag was removed using a nickel rod. Then, an 8-inch tube made of an alloy containing cobalt with nominally 28 weight percent chromium and 6 weight percent molybdenum and formed by an additive manufacturing method (DMLM) was suspended by a clip positioned at the top of the furnace. The tube was lowered into the bath at temperature so that approximately 2 inches of its length was submerged in the melt. It was held, submerged, for 4 hours, and then removed from the melt. Once cooled, the tube was radially cross-sectioned about half an inch from the end and metallographically examined. A significant decrease in roughness of the tube surface was observed.

Example 2

Another experiment similar to EXAMPLE 1 was performed, with immersion time reduced to two minutes. No significant reduction in roughness of the tube surface was observed.

Example 3

Another experiment similar to EXAMPLE 1 was performed, using pure aluminum instead of the aluminum silicon alloy. After immersion for two minutes, no substantial reduction in roughness of the tube surface was observed. However, after immersion for four hours, significant reduction in roughness was observed, similar in degree to that observed for EXAMPLE 1

Example 4

Another experiment similar to EXAMPLE 1 was performed, but the atmosphere was changed to observe what, if any, affect atmosphere may have on the ability of the molten metal to wet the surfaces of the tube. In this case, the loaded crucible was encapsulated in a quartz ampule, then evacuated and back-filled with high purity argon. At a nominal temperature of 750 degrees Celsius, the pressure of this argon atmosphere was about 0.8 atmosphere (81 kPa). A remarkably significant increase in wetting was observed both for external and internal surfaces. Notably, the molten metal intruded into the internal cavity of the tube; smoothing of the tube surfaces occurred both internally and externally.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for reducing surface roughness comprising:

providing an article having a surface having an initial roughness;

providing a molten metal agent suitable for dissolving the surface and/or material on the surface produced by reaction of the agent with the surface;

thereafter contacting at least a portion of the surface with the molten metal agent for a time sufficient to dissolve the portion of the surface and/or material on the surface produced by reaction of the agent with the surface in contact with the molten metal agent to form a coated surface;

wherein the coated surface has a processed roughness that is less than the initial roughness.

2. The method of claim 1, wherein at least a portion of the article, said portion including said surface, comprises additively manufactured material.

3. The method of claim 1, wherein contacting further comprises introducing the agent into an internal channel disposed within the article, and wherein the surface comprises a wall of the internal channel.

4. The method of claim 1, wherein the article is a component of a turbine assembly.

5. The method of claim 1, wherein contacting is performed in an inert atmosphere.

6. The method of claim 1, wherein the initial roughness is an arithmetic average roughness ($R_a$) of at least about 5 micrometers.

7. The method of claim 1, wherein the surface comprises a metal.

8. The method of claim 1, wherein the surface comprises cobalt, iron, nickel, aluminum, titanium, or combinations that include one or more of the aforementioned.

9. The method of claim 1, wherein the surface comprises an alloy comprising cobalt and chromium.

10. The method of claim 9, wherein the alloy comprises from about 26 weight percent to about 30 weight percent chromium, and from about 4 weight percent to about 7 weight percent molybdenum.

11. The method of claim 1, wherein the molten metal agent comprises aluminum, bismuth, tin, or combinations that include one or more of the aforementioned.

12. The method of claim 1, wherein the molten metal agent has a melting point below about 1000 degrees Celsius.

13. The method of claim 1, wherein the molten metal agent comprises aluminum and silicon.

14. The method of claim 1, wherein the molten metal agent comprises aluminum and up to about 14 weight percent silicon.

15. The method of claim 1, wherein the molten metal agent is at a temperature in a range from about 500 degrees Celsius to about 1000 degrees Celsius.

16. The method of claim 1, wherein the molten metal agent comprises a primary metal element and a melting point depressant, wherein the melting point depressant reduces the melting point of the primary metal element from its nominal melting point.

17. The method of claim 16, wherein the melting point depressant comprises boron, silicon lithium, or combinations that include one or more of the aforementioned.

18. The method of claim 1, wherein contacting comprises flowing the agent over the surface.

19. The method of claim 1, wherein contacting comprises dipping the article into the agent.

20. The method of claim 1, wherein the processed roughness is less than about 95% of the initial roughness.

21. The method of claim 1 further comprising mechanically removing a solidified product of the agent from the surface of the article.

22. The method of claim 1 further comprising chemically removing a solidified product of the agent from the surface of the article.

23. The method of claim 1, further comprising pretreating the surface of the article with a surface enhancement aid prior to contact with the molten metal agent wherein the surface enhancement aid increases wetting between the surface and the molten metal agent and/or increases the solubility of surface material in the molten metal agent.

24. The method of claim 1, further comprising forming at least a portion of the article by a process that includes an additive manufacturing step, wherein the portion includes said surface.

25. The method of claim 1, wherein contacting is performed at a pressure below atmospheric pressure.

26. The method of claim 1, wherein the molten metal agent reacts with the surface.

27. A method for reducing surface roughness comprising:

providing an article having a surface having an initial roughness;

providing a molten metal agent suitable for dissolving the surface and/or material on the surface produced by reaction of the agent with the surface;

thereafter contacting at least a portion of the surface with the molten metal agent for a time sufficient to dissolve the portion of the surface and/or material on the surface in contact with the molten metal agent to form a coated surface;

wherein the metal article comprises cobalt and chromium, and the agent comprises aluminum;

and the coated surface has a processed roughness that is less than about 95% of the initial roughness.

* * * * *